US011547248B2

(12) United States Patent
Wood

(10) Patent No.: US 11,547,248 B2
(45) Date of Patent: Jan. 10, 2023

(54) BATH CUSHION FOR A CHILD

(71) Applicant: Tracie Wood, Adrian, MI (US)

(72) Inventor: Tracie Wood, Adrian, MI (US)

( * ) Notice: Subject to any disclaimer, the term of this patent is extended or adjusted under 35 U.S.C. 154(b) by 82 days.

(21) Appl. No.: 17/085,960

(22) Filed: Oct. 30, 2020

(65) Prior Publication Data

US 2021/0137318 A1 May 13, 2021

Related U.S. Application Data

(60) Provisional application No. 62/974,032, filed on Nov. 8, 2019.

(51) Int. Cl.
*A47K 3/12* (2006.01)

(52) U.S. Cl.
CPC ..... *A47K 3/127* (2013.01)

(58) Field of Classification Search
CPC ..... A47K 3/127
USPC ..... 4/572.1
See application file for complete search history.

(56) References Cited

U.S. PATENT DOCUMENTS 5,005,902 A * 4/1991 Farnworth ..... A47D 13/08 D6/333
D445,285 S * 7/2001 Kwapis ..... D21/808
D689,171 S * 9/2013 Morelock ..... D32/57
2007/0022526 A1* 2/2007 Leach ..... A47K 3/127 4/572.1
2008/0127408 A1* 6/2008 First ..... A47K 3/024 4/572.1
2012/0311779 A1* 12/2012 Morelock ..... A47K 3/127 4/572.1

* cited by examiner

*Primary Examiner* — Huyen D Le

(74) *Attorney, Agent, or Firm* — Kunzler Bean & Adamson

(57) ABSTRACT

Bath cushions for a child a disclosed herein. One bath cushion includes a set of perimeter portions including a predefined shape and an integrated center support portion coupled to the set of perimeter portions. The integrated center support portion includes a first non-flat profile and a size and the integrated center support portion is configured to accommodate a child. Another bath cushion includes a set of perimeter portions including a predefined shape and a plurality of removable center support portions coupleable to the set of perimeter portions. The set of perimeter portions includes a center space for coupling one of the plurality of removable center support portions at a time. Further, each center support portion in the plurality of center support portions includes a respective size and a respective first non-flat profile and each center support portion is configured to accommodate a child.

20 Claims, 10 Drawing Sheets

BATH CUSHION FOR A CHILD

CROSS-REFERENCE TO RELATED APPLICATIONS

This application claims priority to and the benefit of U.S. Provisional Patent Application No. 62/974,032, filed on Nov. 8, 2019, the content of which is incorporated herein by reference in its entirety.

FIELD

The subject matter disclosed herein relates to bathing products and, more particularly, relates to a bath cushion for a child.

BACKGROUND

A child (e.g., a newborn, an infant, a toddler, etc.) is often bathed in a bathing environment with a small area (e.g., a sink, a bathtub, etc.). The small size of a child can make it difficult to hold and/or support the child while the child is being bathed in such a bathing environment. Conventional bath cushions do not adequately hold and/or support a child while the child is being bathed, which can make bathing a child more difficult than it otherwise could be.

BRIEF SUMMARY

Various embodiments provide a bath cushion for a child. One bath cushion includes a set of perimeter portions including a predefined shape and an integrated center support portion coupled to the set of perimeter portions. The integrated center support portion includes a first non-flat profile and a size and is configured to accommodate a child.

Another bath cushion includes a set of perimeter portions including a predefined shape and a plurality of removable center support portions coupleable to the set of perimeter portions. The set of perimeter portions includes a center space for coupling one of the plurality of removable center support portions at a time. Further, each center support portion in the plurality of center support portions includes a respective size and a respective first non-flat profile and each center support portion is configured to accommodate a child.

BRIEF DESCRIPTION OF THE DRAWINGS

So that the advantages of the various embodiments will be readily understood, a more particular description of the embodiments briefly described above will be rendered by reference to specific embodiments that are illustrated in the appended drawings. Understanding that these drawings depict only some embodiments and are not therefore to be considered to be limiting of scope, the embodiments will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

In addition, as used herein, the term "set" can mean "one or more," unless expressly specified otherwise. The term "sets" can mean multiples of or a plurality of "one or mores," "ones or more," and/or "ones or mores" consistent with set theory, unless expressly specified otherwise.

Furthermore, the described features, advantages, and characteristics of the embodiments may be combined in any suitable manner. One skilled in the relevant art will recognize that the embodiments may be practiced without one or more of the specific features or advantages of a particular embodiment. In other instances, additional features and advantages may be recognized in certain embodiments that may not be present in all embodiments.

The description of elements in each figure may refer to elements of proceeding figures. Like numbers refer to like elements in all figures, including alternate embodiments of like elements.

Figure 1:
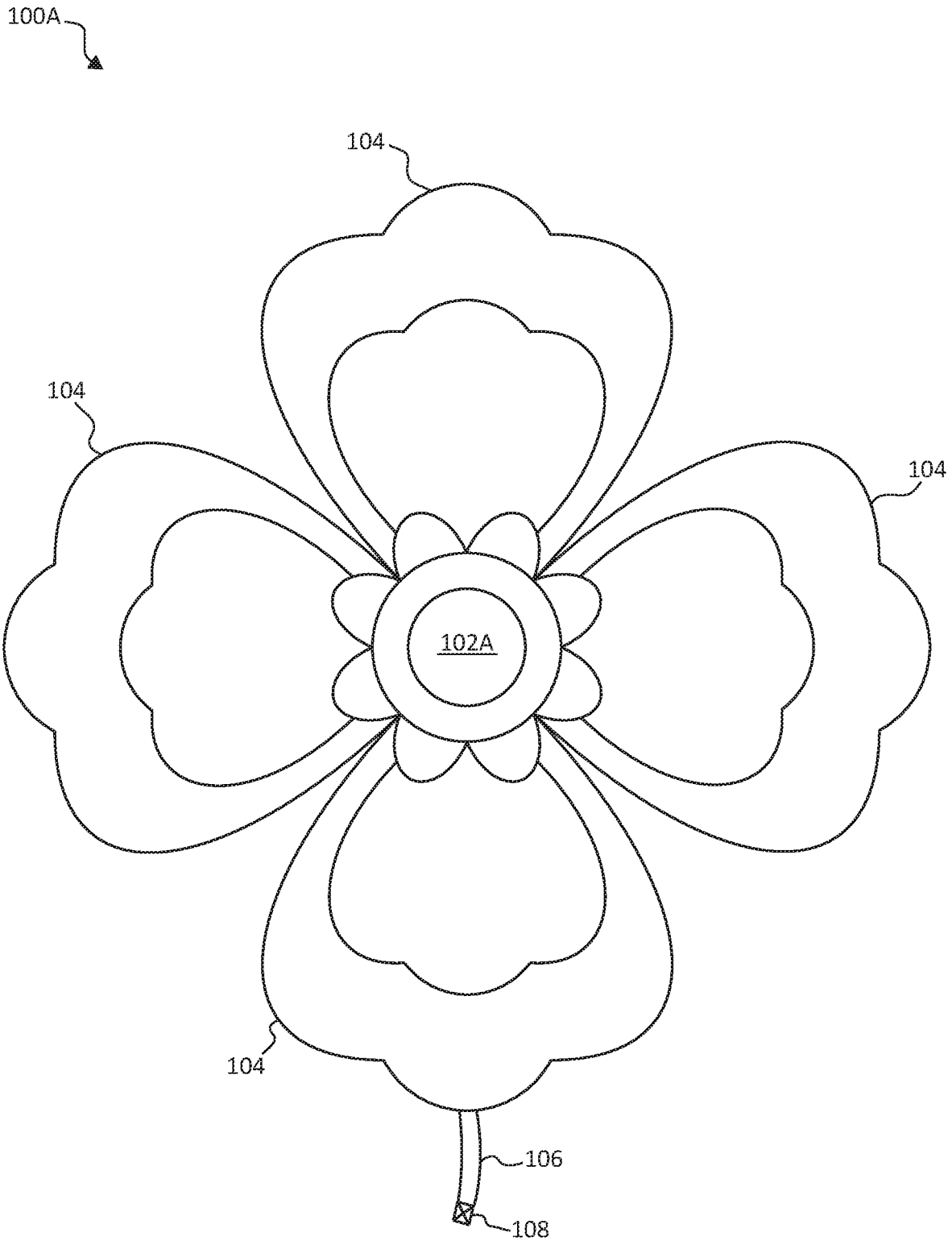
FIG. 1 is a diagram illustrating a top view of one embodiment of a bath cushion.

FIG. 1 is a diagram illustrating a top view of one embodiment of a bath cushion 100A. The bath cushion 100A may include any suitable size and/or shape. In various embodiments, the bath cushion 100A includes a size that can allow the bath cushion 100A to be placed in a sink, a bathtub, or other suitable location for bathing a child.

At least in the illustrated embodiment, the bath cushion 100A includes the shape of a flower. Examples of other suitable shapes include, but are not limited to, a plant, a tree, a human, a robot, a character, an insect, an animal, a bird, an aircraft, and a motor vehicle, etc., among other shapes that are possible and contemplated herein.

At least in the embodiment illustrated in FIG. 1, the bath cushion 100A includes, among other components, a center support portion 102A, a set of perimeter portions 104, and a strap 106. The center portion 102A may be formed of and/or include any suitable material that can be utilized to facilitate bathing a child.

Examples of suitable materials for the center portion 102A include, but are not limited to, a cloth material, a sponge material, and/or a plastic material, etc., among other materials and combinations of materials that are possible and contemplated herein. In certain embodiments, the center portion 102A includes a material capable of absorbing water. In alternative embodiments, the center portion 102A includes a material that is waterproof, water resistant, and/or capable of repelling water.

In various embodiments, the center portion 102A includes a structure that can support and/or provide an amount rigidity that can support a child when the child is placed therein (e.g., while the child is being bathed, prior to bathing, and/or after bathing, etc.). That is, the center portion 102A includes a non-flat and/or three-dimensional structure configured to hold/house a child placed therein such that the child does not fall out and/or otherwise leave the confines of the center portion 102A due to the effects of gravity.

The center portion 102A may include any suitable shape that can support a child placed therein. At least in the embodiment illustrated in FIG. 1, the center portion includes a donut shape and/or a shape similar to a donut. Further, the center portion 102A includes one or more shape elements that coincide with the general overall shape of the bath cushion 100A. Here, the center portion 102A includes one or more elements that resemble the center of a flower.

In additional or alternative embodiments, the center portion 102A includes a circular, generally circular shape, and/or a shape that includes a circumference and/or generally circumferential shape. Other suitable shapes include, but are not limited to a donut, a triangle, a quadrilateral, a polygon with a five or more sides, an oval, an egg shape, and an ellipse, among other shapes that can support/house a child when placed therein that are possible and contemplated herein.

Figure 2:
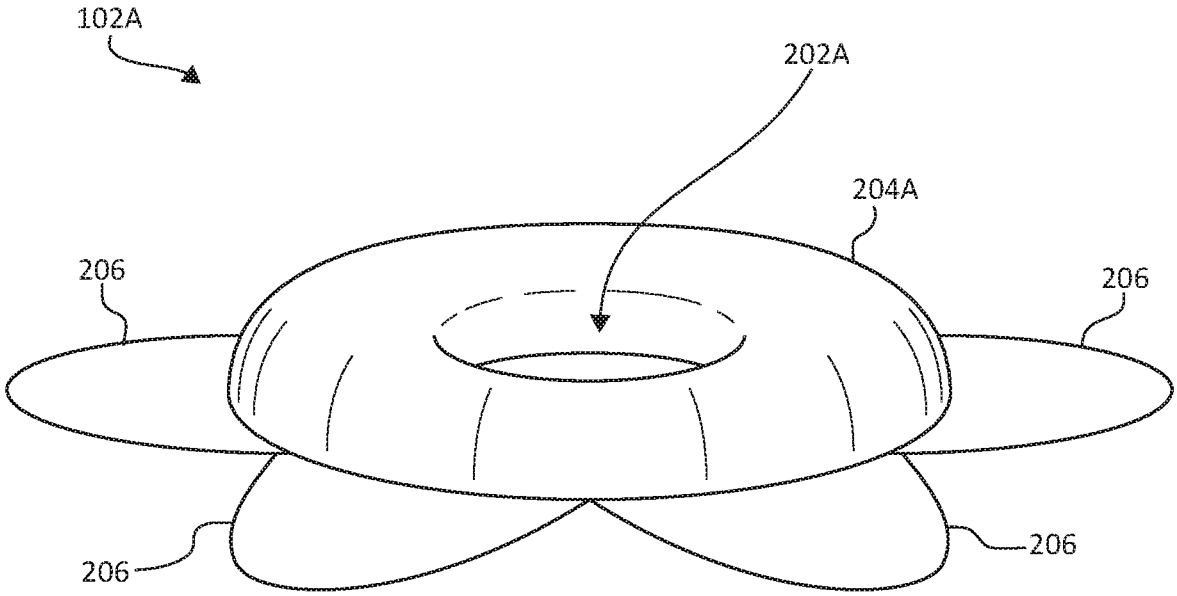
FIG. 2 is a side profile view of one embodiment of a center portion included in the bath cushion illustrated in FIG. 1.

A profile view of one embodiment of the center portion 102A is illustrated in FIG. 2. Here, the center portion 102A includes a central portion 202, a wall structure 204A (e.g., a donut structure or general donut-like structure), and a set of peripheral portions 206. In some embodiments, the central portion 202 is hollow and includes a size suitable for holding/housing all parts of a child. In alternative embodiments, the hollow central portion 202 includes a size that is suitable for holding/housing the body of the child (e.g., all parts of the child except the child's head). In further embodiments, the hollow central portion 202 includes a size that is suitable for holding/housing the buttocks or bottom of the child.

In additional or alternative embodiments, the central portion 202 includes an adjustable size. That is, the size (e.g., the perimeter, the circumference, and/or area, etc.) of the central portion 202 can be increased/decreased by the user to a target size via adjusting the wall structure 204A, as discussed elsewhere herein.

The wall structure 204A, in various embodiments, includes a height and a width defining a non-flat and/or three-dimensional profile for the wall structure 204A. The wall structure 204A may include any suitable height and/or width that can create the central portion 202 of the center portion 102A. That is, the wall structure 204A may include any suitable height and/or width that is suitable for holding/housing the entirety of a child or the body of a child in the central portion 202 (e.g., while the child is being bathed), as discussed elsewhere herein.

For example, the wall structure 204A may include a height configured to provide the hollow central portion 202 with a depth suitable for holding/housing a child of a predetermined size range and/or age range (e.g., a targeted size range and/or age range for a child). In another non-limiting example, the wall structure 204A may include a width that is configured to holdup and/or support the head and/or neck of a child for a predetermined/target age range of children (e.g., 0 years old to about 3 years old, among other ages and/or ranges of age that are possible and contemplated herein).

In some embodiments, the wall structure 204A includes a defined or set perimeter size and/or length. In alternative embodiments, the wall structure 204A includes an adjustable perimeter size and/or length.

Figure 3A:
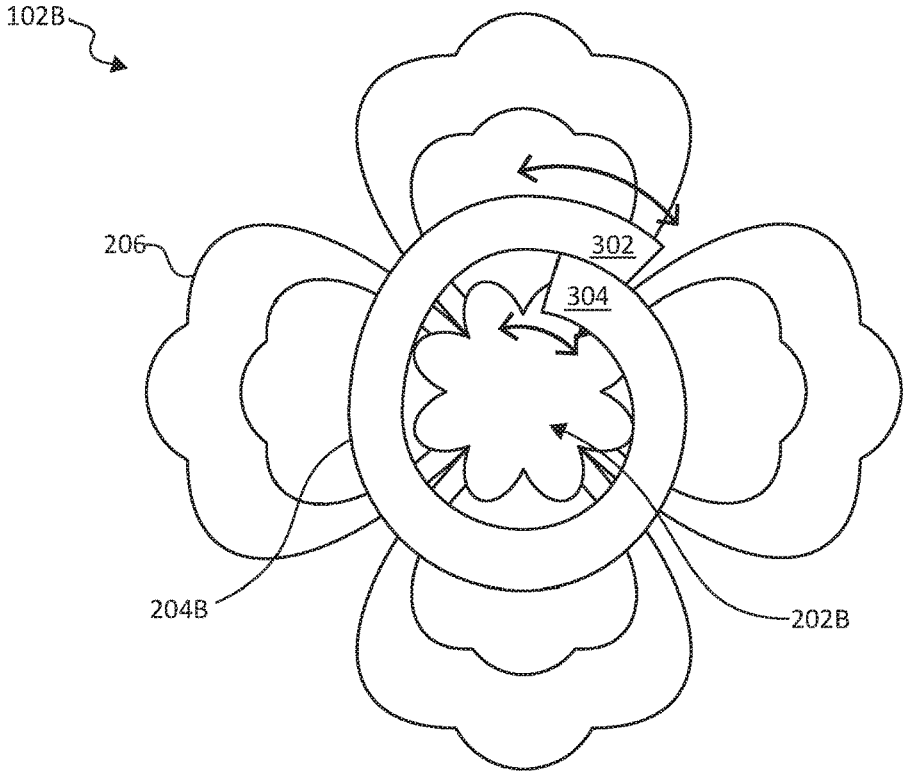
FIGS. 3A and 3B are diagrams illustrating various embodiments of an adjustable center portion that may be included in the bath cushion illustrated in FIG. 1.

In certain embodiments, the wall structure 204A may include one or more mechanisms that allows the size and/or length of the wall structure 204A to be adjustably increased/decreased to a target length, which also directly affects the size (e.g., area and/or circumference, etc.) of the hollow central portion 202. In some embodiments (see, e.g., center portion 102AB in FIG. 3A), a wall structure 204B may be non-continuous such that two wall portions of the wall structure 204B (e.g., wall portion 302 and wall portion 304) can overlap one another to increase/decrease the effective length (e.g., the length of the wall structure utilized to define the perimeter of the central portion 202) of the wall structure 204B as wall portion 302 is moved relative to wall portion 304.

Figure 3B:
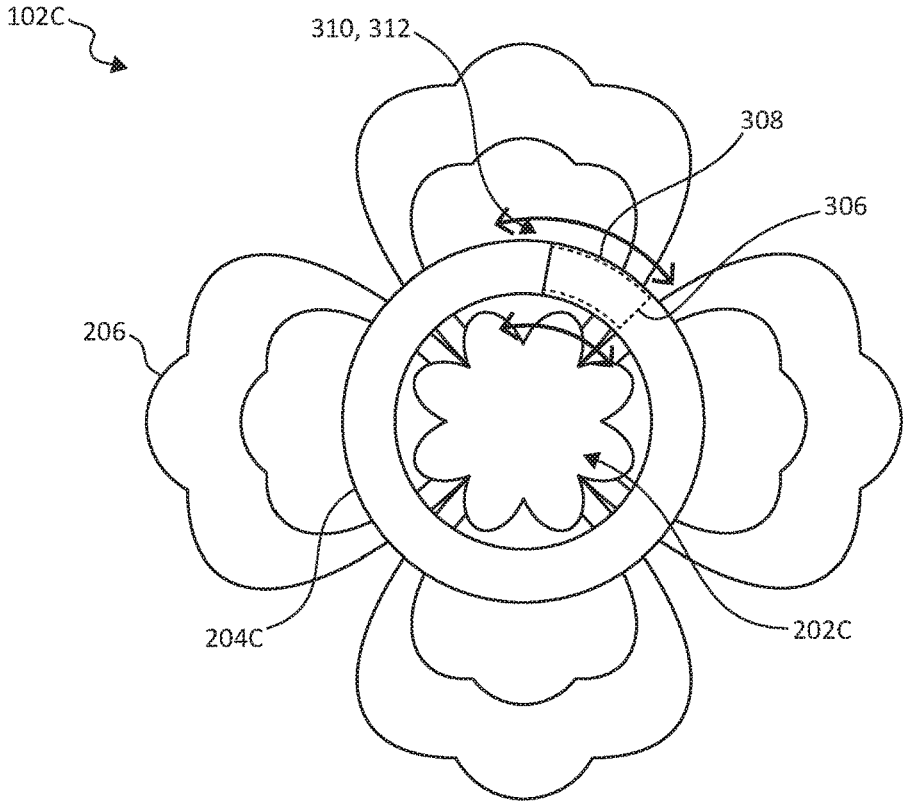

In other embodiments (see, e.g., center portion 102A in FIG. 3B), the wall structure 204C may include a pair of wall portions (e.g., wall portion 306 and wall portion 308) with different heights (e.g., wall portion 308 is taller than wall portion 306) and in which wall portion 308 includes an aperture 310 and a cavity 312 with a size capable of accommodating at least a portion of the wall portion including the shorter height (e.g., wall portion 306). Here, the wall portion 306 can be inserted into the aperture 310 and cavity 312 such that wall portions 306 and 308 can overlap one another to increase/decrease the effective length (e.g., the length of the wall structure utilized to define the perimeter of the central portion 202) of the wall structure 204C.

Referring again to FIG. 2, the set of peripheral portions 206 may include any suitable quantity of peripheral portions 206. In various embodiments, the set of peripheral portions 206 may include a quantity of peripheral portions 206 in the range of one peripheral portion 206 to about ten (10) peripheral portions 206, among other quantities of peripheral portions 206 greater than ten that are possible and contemplated herein. In various embodiments, the quantity of peripheral portions 206 can vary based on a type of design and/or a type of sub-design within a particular type of design. In certain embodiments, a center portion 102A may be devoid of any peripheral portions 206.

With reference again to FIG. 1, the set of perimeter portions 104 may include any suitable quantity of perimeter portions 104. In various embodiments, the set of perimeter portions 104 may include a quantity of perimeter portions 104 in the range of one perimeter portion 104 to about ten perimeter portions 104, among other quantities of perimeter portions 104 greater than ten that are possible and contemplated herein.

At least in the illustrated embodiment, the bath cushion 100A includes four (4) perimeter portions 104. Here, the set of perimeter portions 104 define petals of a flower design. As discussed elsewhere herein, other embodiments of a bath cushion 100A may include one of numerous designs. In the various other embodiments, the quantity of perimeter portions 104 can vary based on a type of design and/or a type of sub-design within a particular type of design.

For example, different types of flower designs may include different quantities of perimeter portions 104. In a specific non-limiting example, a sunflower design may include a greater quantity of perimeter portions 104 than a daisy design or vice-versa, among other designs and/or combinations of comparative designs that are possible and contemplated herein. In other non-limiting examples, different types of plants, trees, humans, robots, characters, insects, animals, birds, aircraft, and motor vehicles may include different quantities of perimeter portions 104 from one another within their respective design types and across different design types.

Each perimeter portion 104 may be formed of and/or include any suitable material that can be utilized to facilitate bathing a child. Examples of suitable materials for a perimeter portion 104 include, but are not limited to, a cloth material, a sponge material, a plastic material or an organic material, etc., among other materials and combinations of materials that are possible and contemplated herein. In certain embodiments, one or more perimeter portions 104 include a material capable of absorbing water. In additional or alternative embodiments, one or more perimeter portions 104 include a material that is waterproof, water resistant, and/or capable of repelling water.

In further additional or alternative embodiments, at least two (2) perimeter portions 104 include different materials and/or combinations of different materials. For example, at least one perimeter portion 104 may include and/or be formed of a cloth material and at least one other perimeter portion 104 may include and/or be formed of a plastic material, among other types of suitable materials and/or comparative combinations of suitable materials that are possible and contemplated herein. In another non-limiting example, at least one perimeter portion 104 may include and/or be formed of a first organic material and at least one other perimeter portion 104 may include and/or be formed of a different organic material.

In some embodiments, the set of perimeter portions 104 includes a flat and/or relatively flat profile. In other embodiments, the set of perimeter portions 104 includes a non-flat and/or three-dimensional profile. In still other embodiments, one or more perimeter portions 104 in the set of perimeter portions 104 includes a flat or relatively flat profile and one or more other perimeter portions 104 in the set of perimeter portions 104 includes a non-flat and/or three-dimensional profile.

In additional or alternative embodiments, the sides of one or more perimeter portions 104 in the set of perimeter portions 104 is foldable to create an individual structure similar to a cradle and/or a cupped-like structure. In certain embodiments, the sides of each (all) of the perimeter portions 104 in the set of perimeter portions 104 is foldable to create multiple individual structures similar to a cradle and/or a cupped-like structure.

In further additional or alternative embodiments, two or more perimeter portions 104 in the set of perimeter portions 104 are foldable to create a collective structure similar to a cradle and/or a cupped-like structure. In certain embodiments, each (all) of the perimeter portions 104 in the set of perimeter portions 104 are foldable to create a collective structure similar to a cradle and/or a cupped-like structure.

Figure 4:
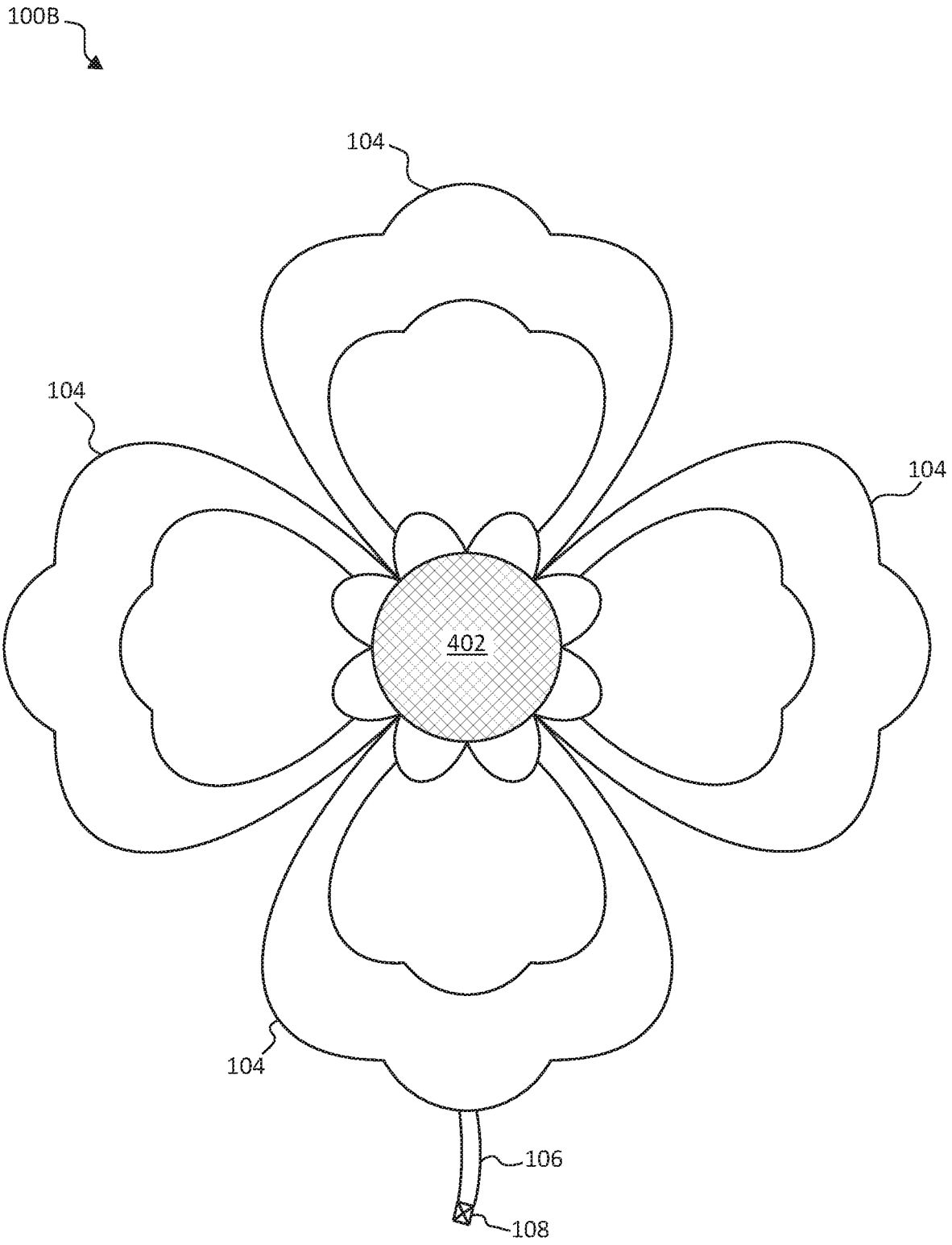
FIG. 4 is a diagram illustrating a top view of another embodiment of a bath cushion.

With reference to FIG. 4, another embodiment of a bath cushion 100B is illustrated. The bath cushion 100B includes a set of perimeter portions 104 and a strap 106 with a securing mechanism 108 similar to the bath cushion 100A discussed elsewhere herein.

At least in the illustrated embodiment, the bath cushion 100B further includes a securing portion 402 coupled to the set of perimeter portions 104 such that the set of perimeter portions 104 and the securing portion 402 are coupled/connected to one another. In various embodiments, the bath cushion 100B further includes a set of detachable and/or interchangeable center portions 102D, 102E, and 102*n*, which may be referred to as set 600 (see, e.g., FIG. 6).

The securing portion 402 may include any suitable mechanism capable of securing the center portions 102D, 102E, and 102*n* to the set of perimeter portions 104. Examples of suitable mechanisms for securing portion 402 include, but are not limited to, hook and loop fasteners (e.g., Velcro®), snaps, buttons, tie strings, and the like mechanisms, among other types of mechanisms that are capable of securing the center portions 102D, 102E, and 102*n* to the set of perimeter portions 104 that are possible and contemplated herein.

Figure 5:
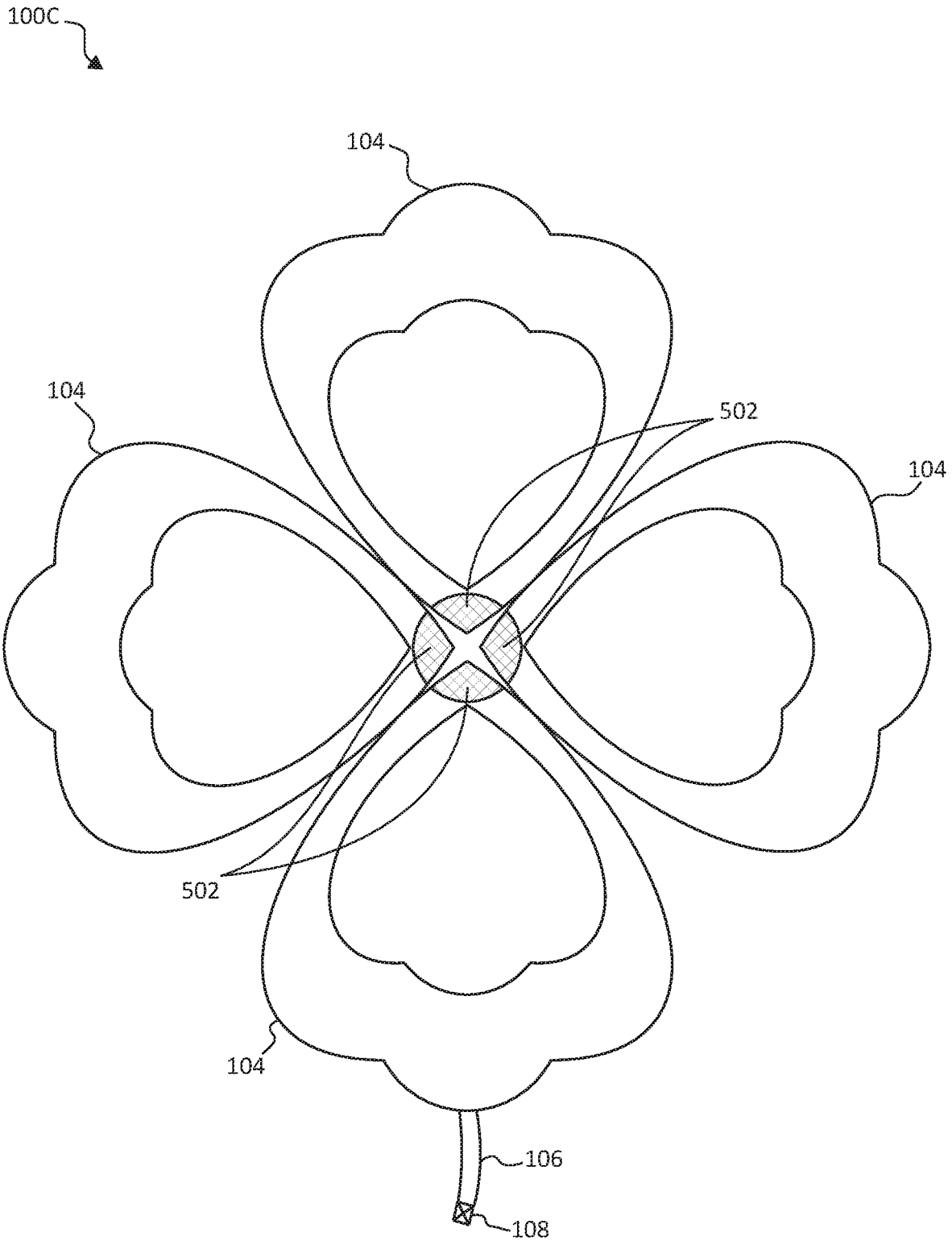
FIG. 5 is a diagram illustrating a top view of yet another embodiment of a bath cushion.

Referring now to FIG. 5, another embodiment of a bath cushion 100C is illustrated. The bath cushion 100C includes a set of perimeter portions 104' in which one or more perimeter portions 104' includes a strap 106 with a securing mechanism 108 similar to the bath cushions 100A and 100B discussed elsewhere herein. In various embodiments, the bath cushion 100B further includes a set of detachable and/or interchangeable center portions 102D, 102E, and 102*n*, which may be referred to as set 600 (see, e.g., FIG. 6).

At least in the illustrated embodiment, each perimeter portion 104' includes a securing portion 502 for securing each perimeter portion 104' to the center portions 102D, 102E, and 102*n*. The securing portion 502 may include any suitable mechanism capable of securing the center portions 102D, 102E, and 102*n* to the set of perimeter portions 104'. Examples of suitable mechanisms for securing portion 502 include, but are not limited to, hook and loop fasteners (e.g., Velcro®), snaps, buttons, tie strings, and the like mechanisms, among other types of mechanisms that are capable of securing the center portions 102D, 102E, and 102*n* to the set of perimeter portions 104' that are possible and contemplated herein.

Figure 6:
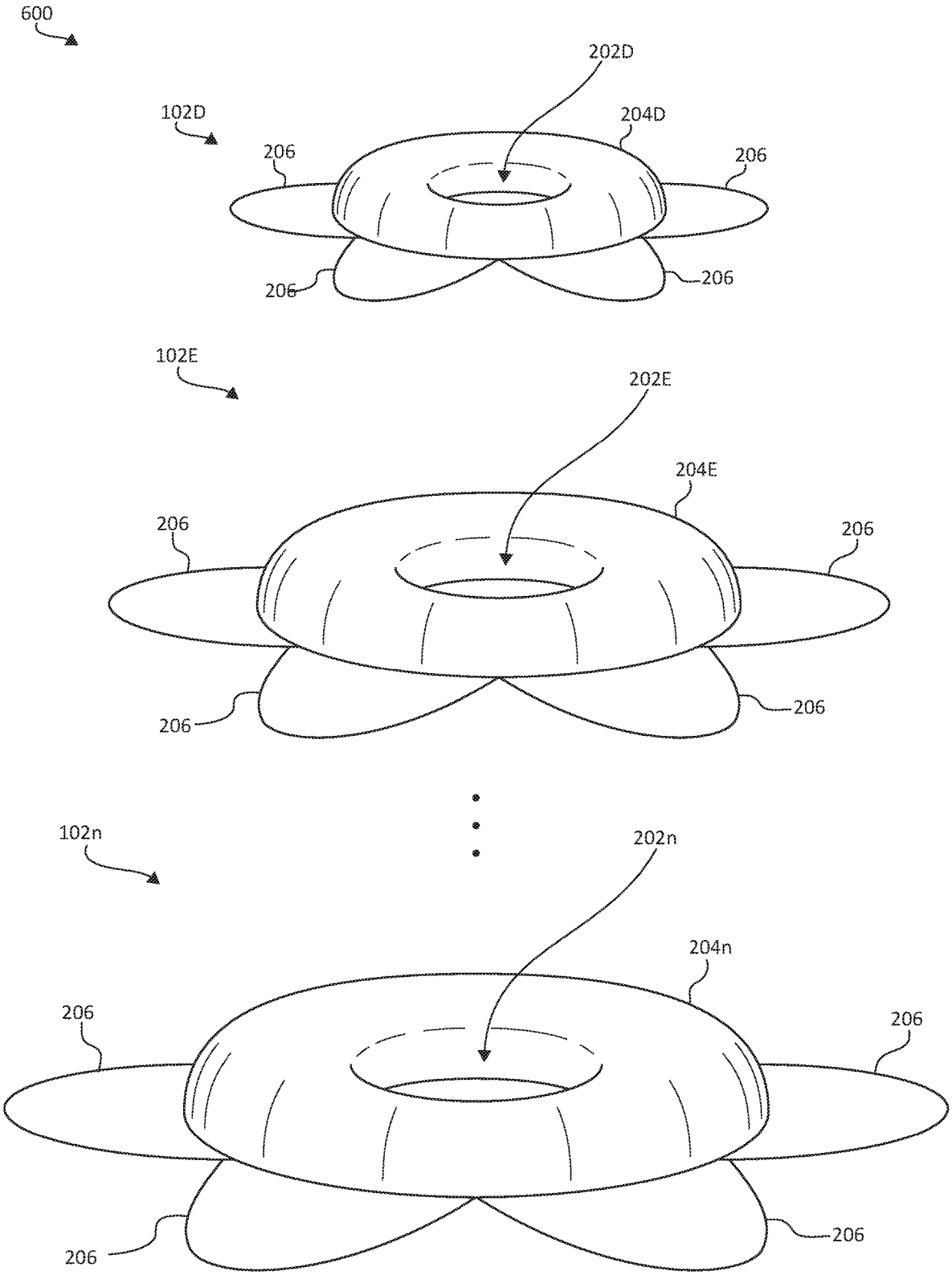
FIG. 6 is a diagram of one embodiment of a set of detachable and/or interchangeable center portions that can be included in the bath cushions illustrated in FIGS. 4 and 5.

FIG. 6 is a diagram of one embodiment of a set 600 of detachable and/or interchangeable center portions 102D, 102E, and 102*n*. The center portions 102D, 102E, and 102*n* may be similar to the center portion 102A, as discussed elsewhere herein.

In various embodiments, the center portions 102D, 102E, and 102*n* each include a different size to accommodate a child or children having different sizes and/or ages. That is, central portions 202D, 202E, and 202*n* each include a different size and/or area. Further, wall structures 204D, 204E, and 204*n* may each include the same height or different heights. Additionally, wall structures 204D, 204E, and 204*n* may each include the same length or different lengths.

In some embodiments, wall structures 204D, 204E, and 204*n* may each include the same height and different lengths. In other embodiments, wall structures 204D, 204E, and 204*n* may each include the different heights and the same length. In still other embodiments, wall structures 204D, 204E, and 204*n* may each include different heights and different lengths.

A set 600 of wall structures may include any suitable quantity greater than or equal to two (2) wall structures. At least in the illustrated embodiment, the set 600 includes three (3) wall structures (e.g., wall structures 204D, 204E, and 204*n*). Other embodiments may include two wall structures (e.g., wall structures 204D and 204E) or a quantity greater than three wall structures.

Figure 7:
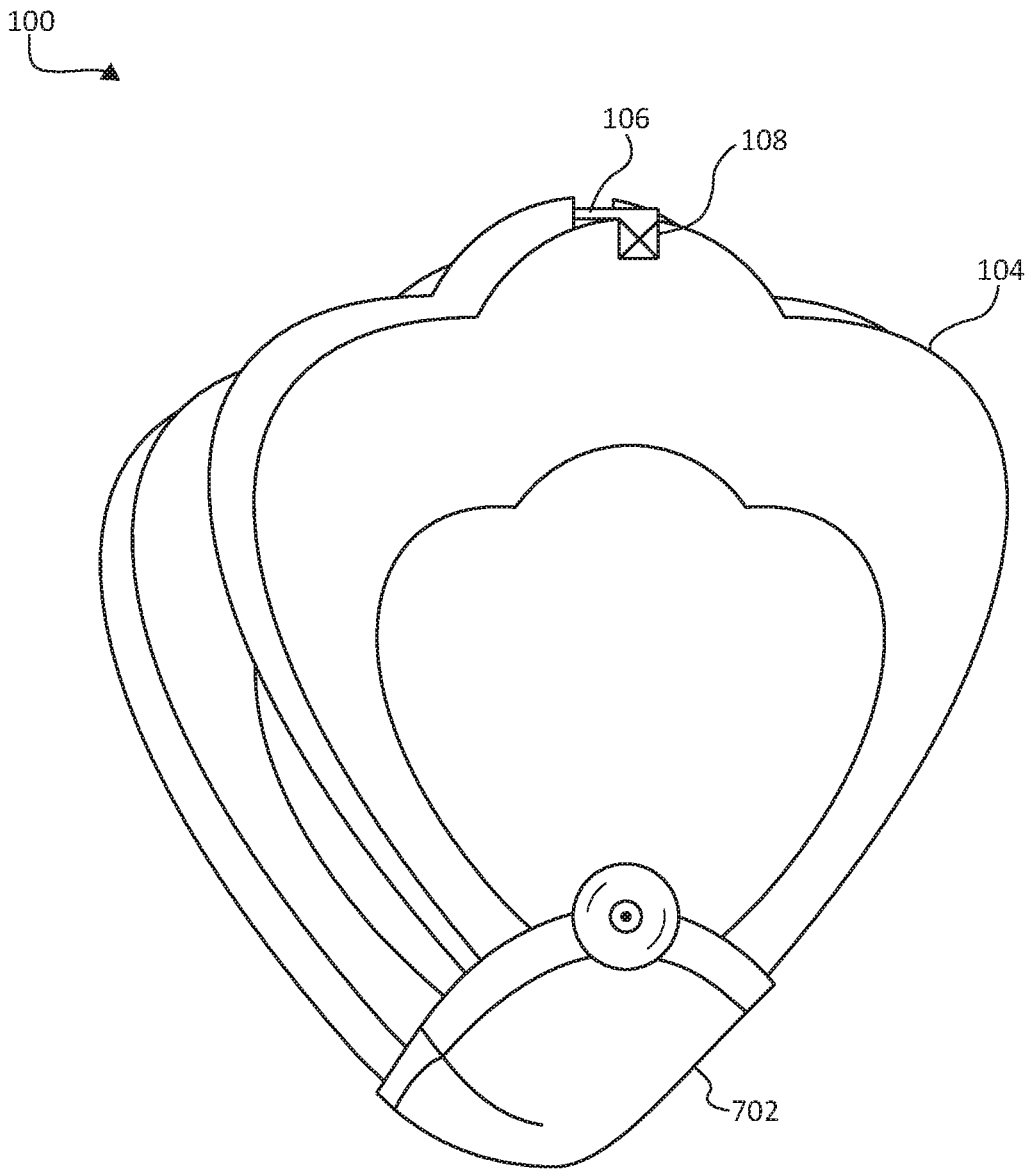
FIG. 7 is a diagram illustrating the bath cushions illustrated in FIGS. 1, 4, and 5 in a folded state.

The bath cushions 100A, 100B, and 100C (also simply referred individually, in various groups, or collectively as bath cushion(s) 100), in various embodiments, are configured to be foldable for storage and/or transport of the bath cushion 100 (see, e.g., FIG. 7). As illustrated in the various embodiments, the bath cushion 100 includes the strap 106 for securing and maintaining the bath cushion 100 in a folded state.

The strap 106 may include and/or be formed of any suitable material capable of securing the bath cushion 100 in the folded state. Further, the strap 106 may include a securing mechanism 108 to facilitate securing the bath cushion 100 in the folded state.

The securing mechanism 108 may include any suitable mechanism capable of securing and/or maintaining the bath cushion 100 in the folded state. Examples of suitable mechanisms for securing the bath cushion 100 in the folded state include, but are not limited to, hook and loop fasteners (e.g., Velcro®), snaps, buttons, tie strings, and the like mechanisms, among other types of mechanisms that are capable of securing the bath cushion 100A in the folded state that are possible and contemplated herein.

In some embodiments (see, e.g., FIG. 4), the bath cushion 100 includes a receptacle 702 for holding the bath cushion 100 when the bath cushion 100 is in the folded state. The receptacle 702 may include and/or be formed of any suitable material (e.g., cloth, plastic, an organic material, etc.) or suitable combination of materials that can hold the bath cushion 100 when the bath cushion 100 is in the folded state.

At least in the illustrated embodiment, receptacle 702 includes a pocket. Other non-limiting examples of a receptacle 702 include, but are not limited to, a pocket, a pouch, a purse, a bag, and a backpack, etc., among other types of mechanisms capable of holding the bath cushion 100 when the bath cushion 100 is in the folded state for storage and/or transport.

The manner in which the bath cushion 100 is folded can vary based on the type and/or design of the bath cushion 100. While FIG. 7 illustrates the manner in which one embodiment of a flower design may be folded, other types of flower designs, types of designs, and/or types of sub-designs may be folded in one or more different ways and/or in a different manner, each of which possibility is contemplated and included herein.

Figure 8:
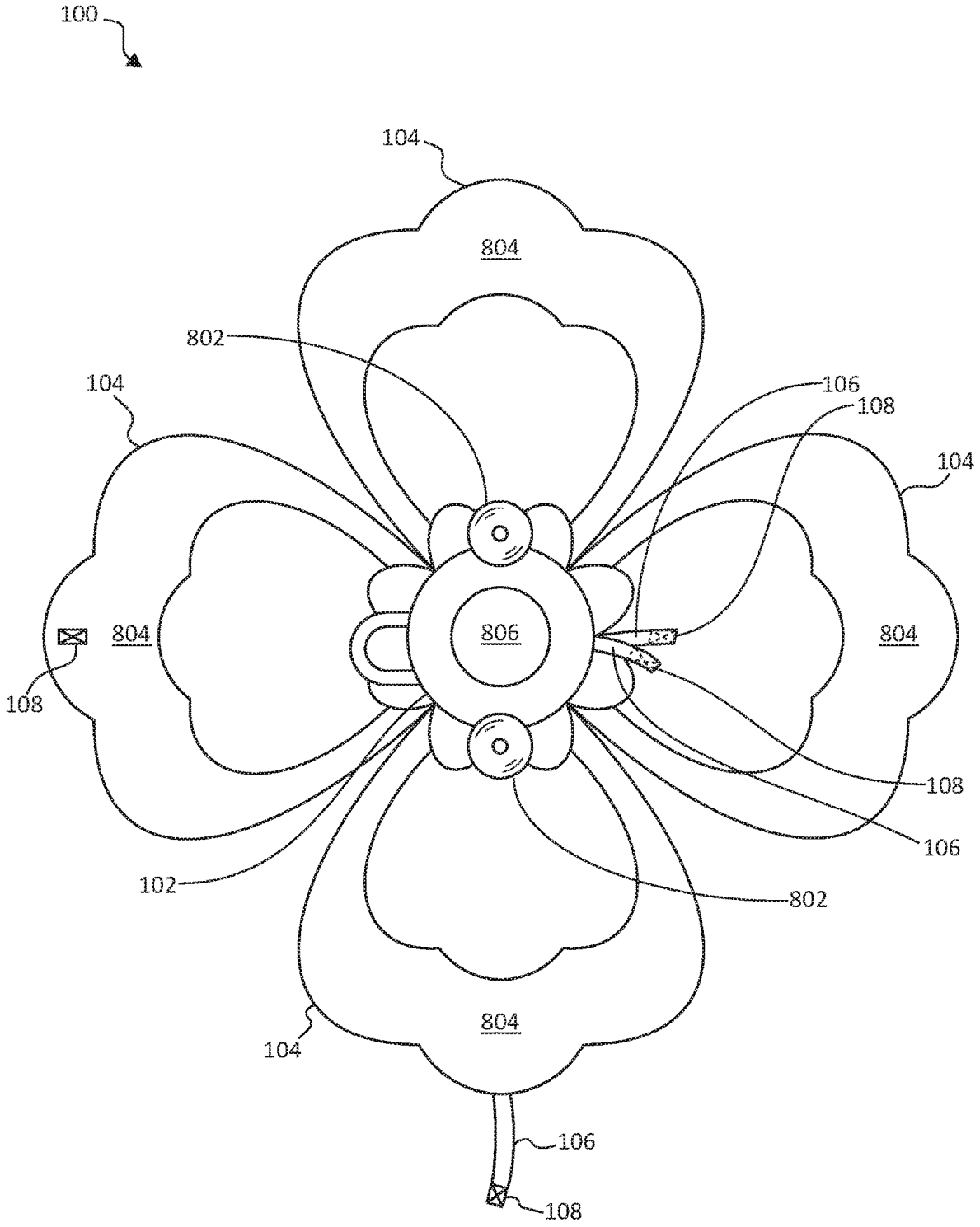
FIG. 8 is a diagram illustrating one embodiment of a bottom view of the bath cushion illustrated in FIGS. 1, 4, and 5.

With reference now to FIG. 8, FIG. 8 illustrates one embodiment of a bottom view of a bath cushion 100. At least in the illustrated embodiment, the bath cushion 100 further includes a set of non-slip mechanisms 802.

A set of non-slip mechanisms 802 may include any suitable quantity of non-slip mechanisms 802 that can secure the bath cushion 100 to an external surface (e.g., a sink, a bathtub, etc.). At least in the illustrated embodiment, the set of non-slip mechanisms 802 includes two non-slip mechanisms 802. In other embodiments, the set of non-slip mechanisms 802 may include one non-slip mechanism 802 or any quantity of non-slip mechanisms 802 greater than two non-slip mechanisms 802.

Further, each non-slip mechanism 802 in a set of non-slip mechanisms 802 may be placed at any suitable location, respectively, on the bottom of the bath cushion 100. At least in the illustrated embodiment, the non-slip mechanisms 802 are located on opposite sides of the center portions 102A, 102B, 102C, 102D, 102E, and 102*n* (also simply referred individually, in various groups, or collectively as center portion(s) 102) at a position transitioning between the center portion 102 and a respective one of the perimeter portions 104 or the perimeter portions 104' (also simply referred individually, in various groups, or collectively perimeter portion(s) 104).

Other embodiments include a greater quantity of non-slip mechanisms 802, which may include a non-slip mechanism 802 located on one or more perimeter portions 104, one or more non-slip mechanisms 802 located on each perimeter portion 104, one or more non-slip mechanisms 802 located on the center portion 104, and/or one or more non-slip mechanisms 802 located at a position transitioning between the center portion 102 and a respective one of the perimeter portions 104. In some embodiments, two pairs of non-slip mechanisms 802 are located on opposite sides of the center portion 102 at positions transitioning between the center portion 102 and a respective one of the perimeter portions 104. In some embodiments, the bath cushion 100 is devoid of any non-slip mechanisms 802.

A non-slip mechanism 802 may include any suitable mechanism that can secure (e.g., temporarily attach) the bath cushion 100 to the external surface such that the bath cushion 100 is prevented and/or at least impeded from moving/shifting positions while the bath cushion 100 is secured to the external surface. That is, the non-slip mechanism(s) 802 can hold the bath cushion 100 in place while a child is being bathed therein. In various embodiments, a non-slip mechanism 802 includes and/or forms a suction cup, among other mechanisms that can prevent and/or at least impede the bath cushion 100 from moving/shifting positions while the bath cushion 100 is secured to an external surface that are possible and contemplated herein.

In additional or alternative embodiments, one or more perimeter portions 104 include a non-slip or substantially non-slip bottom surface 804. That is, the bottom surface 804 of one or more perimeter portions 104 includes and/or is formed of a non-slip material. As such, one or more perimeter portions 104 may include different materials on the bottom and top surfaces. In the embodiment illustrated in FIG. 8, each of the perimeter portions 104 (e.g., all of the perimeter portions 104) include a non-slip or substantially non-slip bottom surface 804.

A non-slip or substantially non-slip bottom surface 804 may include and/or be formed of any suitable material that can prevent and/or at least impede the bath cushion 100 from moving/shifting positions while the bath cushion 100 is in contact with an external surface. In additional or alternative embodiments, one or more bottom surfaces 804 of the set of perimeter portions 104 may include one or more features and/or characteristics that provide a bottom surface 804 with one or more non-slip properties (e.g., a rough surface, a non-smooth surface, and/or a non-homogenous surface, etc., among other properties that can prevent or substantially prevent the bath cushion 100 from slipping/moving or at least reduce the propensity of the bath cushion 100 to slip/move when exposed to water and/or moisture that are possible and contemplated herein).

In various embodiments, a non-slip or substantially non-slip bottom surface 804 of a perimeter portion 104 may include and/or be formed of a material having a relatively high coefficient of friction (0. In additional or alternative embodiments, a non-slip or substantially non-slip bottom surface 804 of a perimeter portion 104 may include one or more features and/or properties that provide a relatively high coefficient of friction (μ) to the bath cushion 100 when exposed to water and/or moisture.

In further additional or alternative embodiments, at least a portion of the center portion 102 includes a non-slip or substantially non-slip bottom surface 806. That is, at least a portion of the bottom surface 806 of the center portion 102 includes and/or is formed of a non-slip material. As such, the center portion 102 may include different materials on the bottom and top surfaces. In the embodiment illustrated in FIG. 8, the entirety (all) of the bottom surface 806 of the center portion 102 is a non-slip or substantially non-slip bottom surface 806.

A non-slip or substantially non-slip bottom surface 806 may include and/or be formed of any suitable material that can prevent and/or at least impede the bath cushion 100 from moving/shifting positions while the bath cushion 100 is in contact with an external surface. In additional or alternative embodiments, the bottom surface 806 of the center portion 102 may include one or more features and/or characteristics that provide a bottom surface 806 with one or more non-slip properties (e.g., a rough surface, a non-smooth surface, and/or a non-homogenous surface, etc., among other properties that can prevent or substantially prevent the bath cushion 100 from slipping/moving or at least reduce the propensity of the bath cushion 100 to slip/move when exposed to water and/or moisture that are possible and contemplated herein).

In various embodiments, a non-slip or substantially non-slip bottom surface 806 of a center portion 102 may include and/or be formed of a material having a relatively high coefficient of friction (p). In additional or alternative embodiments, a non-slip or substantially non-slip bottom surface 806 of a center portion 102 may include one or more features and/or properties that provide a relatively high coefficient of friction (p) to the bath cushion 100 when exposed to water and/or moisture.

Figure 9:
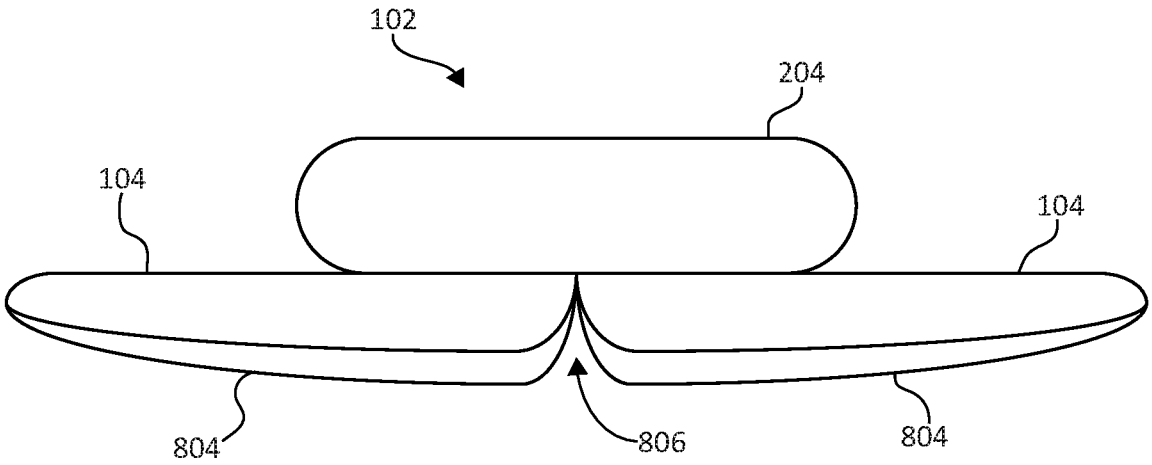
FIG. 9 is a diagram illustrating one embodiment of a side profile of the bath cushion illustrated in FIGS. 1, 4, and 5.

Referring to FIG. 9, one embodiment of a side profile of a bath cushion 100 is illustrated. As shown, the wall structure 204 defines a non-flat and/or a three-dimensional top profile for the center portion 102. In some embodiments, the non-flat and/or a three-dimensional profile of the wall structure 204 is with respect to the profile of one or more of the perimeter portions 104. At least in the illustrated embodiment, the non-flat and/or a three-dimensional profile of the center portion 102 and/or the wall structure 204 is with respect to the profile of each or all of the perimeter portions 104. That is, the center portion 102 and/or the wall structure 204 and the perimeter portions 104 are not in the same plane (e.g., the center portion 102 and/or the wall structure 204 is/are not co-planar with the perimeter portions 104).

In various embodiments, the top of each or all of the perimeter portions 104 include and/or define a flat or substantially flat profile for the portion of the top of the bath cushion 100A not included as part of the center portion 102 or wall portion 204. As such, the top of the bath cushion 100 includes and/or defines a profile including one or more flat and/or relatively flat portions (e.g., the perimeter portion(s) 102) and a non-flat and/or three-dimensional portion (e.g., the center portion 102 and wall structure 204).

In additional or alternative embodiments, the bottom surface 804 of one or more of the perimeter portions 104 includes and/or defines a flat or substantially flat profile. In further additional or alternative embodiments, the bottom surface 806 of the center portion 102 includes and/or defines a flat or substantially flat profile. As such, the bottom of the bath cushion 100 includes and/or defines a flat and/or relatively flat profile.

At least in the illustrated embodiment, the top of each or all of the perimeter portions 104 include and/or define a flat or substantially flat profile, the bottom surface 804 of each or all of the perimeter portions 104 include and/or define a flat or substantially flat profile, and the bottom surface 806 of the center portion 102 includes and/or defines a flat or substantially flat profile. As further illustrated in this embodiment, the center portion 102 and the wall structure 204 include and/or define a non-flat and/or a three-dimensional profile with respect to the profile of the perimeter portions 104.

Figure 10:
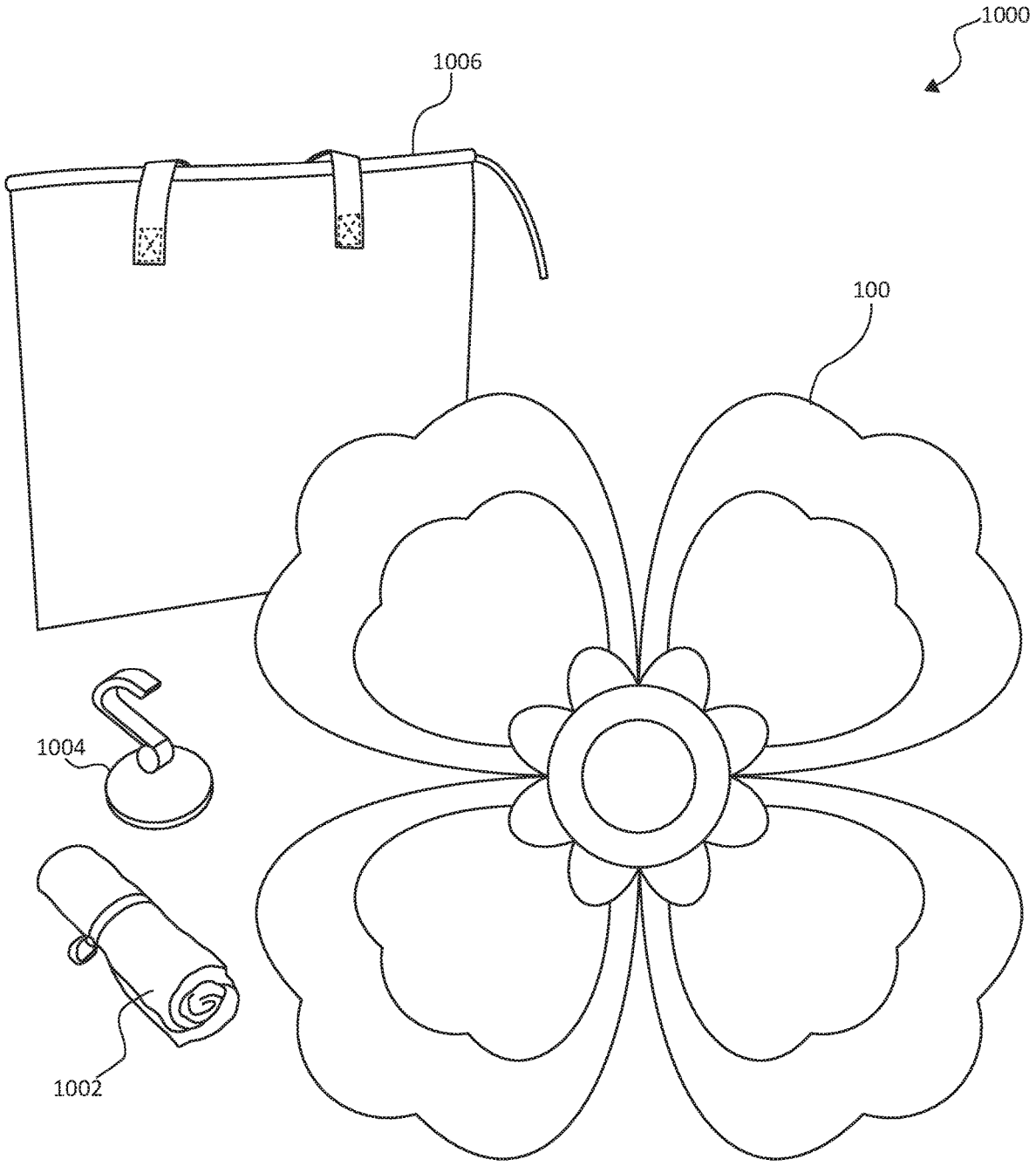
FIG. 10 is a diagram illustrating one embodiment of a bath system including the bath cushion illustrated in FIG. 1, 4, or 5.

Referring to FIG. 10, FIG. 10 illustrates one embodiment of a bath system 1000 for bathing a child. At least in the illustrated embodiment, the bath system 1000 includes, among other components, a bath cushion 100 (e.g., bath cushion 100A, 100B, or 100C), a wash cloth 1002, a drying hook 1004, and a bag 1006 or pouch for storing and/or transporting the bath cushion 100, the wash cloth 1002, and the drying hook 1004.

The embodiments may be practiced in other specific forms. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A bath cushion, comprising:

a set of perimeter portions including a predefined shape; and an integrated center support portion coupled to the set of perimeter portions, wherein:

the integrated center support portion includes a bottom surface, a donut structure including a first non-flat profile positioned above the bottom surface, and a size, the donut structure includes a hollow portion positioned above the bottom surface and a wall structure surrounding the hollow portion in which the bottom surface provides a material structure below the donut structure, and the integrated center support portion is configured to accommodate a child.

2. The bath cushion of claim 1, wherein the set of perimeter portions are deformable to include a second non-flat profile.

3. The bath cushion of claim 2, wherein the size is adjustable within a range of sizes.

4. The bath cushion of claim 1, wherein the size is adjustable within a range of sizes.

5. The bath cushion of claim 1, wherein the predefined shape is one of a plant, an animal, and a vehicle.

6. The bath cushion of claim 1, wherein the predefined shape comprises a flower including a second non-flat profile.

7. The bath cushion of claim 1, wherein the predefined shape comprises a flower including a second non-flat profile.

8. The bath cushion of claim 7, wherein the donut structure is adjustable within a range of sizes.

9. The bath cushion of claim 1, wherein the donut structure is adjustable within a range of sizes.

10. The bath cushion of claim 1, wherein the bottom surface comprises a non-slip material.

11. The bath cushion of claim 1, wherein the bottom surface comprises a non-slip property.

12. The bath cushion of claim 11, wherein the non-slip property comprises one of a rough surface, a non-smooth surface, and a non-homogenous surface.

13. The bath cushion of claim 1, wherein the bottom surface comprises two non-slip properties.

14. The bath cushion of claim 13, wherein the two non-slip properties comprise two of a rough surface, a non-smooth surface, and a non-homogenous surface.

15. The bath cushion of claim 1, wherein the bottom surface comprises three non-slip properties.

16. The bath cushion of claim 15, wherein the three non-slip properties comprise each of a rough surface, a non-smooth surface, and a non-homogenous surface.

17. The bath cushion of claim 1, wherein the bottom surface comprises a material including a high coefficient of friction.

18. The bath cushion of claim 1, wherein the bottom surface comprises a material including a high coefficient of friction when exposed to moisture.

19. The bath cushion of claim 1, wherein the bottom surface comprises a material including a high coefficient of friction when exposed to water.

20. The bath cushion of claim 1, wherein the bottom surface comprises a material that impedes movement of the bath cushion when the bottom surface is exposed to of moisture and water.

* * * * *